US007870617B2

(12) United States Patent
Butler

(10) Patent No.: US 7,870,617 B2
(45) Date of Patent: Jan. 18, 2011

(54) PROTECTIVE HELMET WITH ADJUSTABLE SUPPORT

(76) Inventor: Alan M. Butler, 29 Myron Rd., Plainview, NY (US) 11803

( * ) Notice: Subject to any disclaimer, the term of this patent is extended or adjusted under 35 U.S.C. 154(b) by 1169 days.

(21) Appl. No.: 11/397,640

(22) Filed: Apr. 5, 2006

(65) Prior Publication Data

US 2007/0245468 A1 Oct. 25, 2007

(51) Int. Cl.
*A41D 13/00* (2006.01)

(52) U.S. Cl. ..... 2/410

(58) Field of Classification Search ..... 2/410–411, 2/417–421, 425, 414
See application file for complete search history.

(56) References Cited

U.S. PATENT DOCUMENTS

| | | | | |
|---|---|---|---|---|
| 1,886,551 | A | 11/1932 | Jones | |
| 3,054,111 | A | 9/1962 | Hornickel et al. | |
| 3,590,388 | A | 7/1971 | Holt | 2/3 |
| 3,633,214 | A | 1/1972 | Newcomb | 2/3 |
| 3,797,039 | A | 3/1974 | Penberthy | 2/3 |
| 3,916,446 | A | 11/1975 | Gooding | 2/3 |
| D241,888 | S | 10/1976 | Lipper | D2/102 |
| 3,994,020 | A | 11/1976 | Villari | 2/413 |
| 4,064,565 | A | 12/1977 | Griffiths | 2/412 |
| 4,477,929 | A | 10/1984 | Mattsson | 2/425 |
| 4,651,356 | A | 3/1987 | Zide | 2/421 |
| 5,175,889 | A | 1/1993 | Infusino | 2/413 |
| D352,803 | S | 11/1994 | Sasaki et al. | D29/102 |
| 5,450,631 | A | 9/1995 | Egger | 2/425 |
| D367,341 | S | 2/1996 | Losi, II | D29/102 |
| D372,559 | S | 8/1996 | Murakami | D27/102 |
| D373,857 | S | 9/1996 | Fujita | D29/106 |
| D378,236 | S | 2/1997 | Zanotto et al. | D29/102 |
| 5,619,756 | A | 4/1997 | Garneau | 2/425 |
| 5,651,145 | A | 7/1997 | Egger | 2/425 |
| D383,249 | S | 9/1997 | Ho | D29/102 |
| D387,501 | S | 12/1997 | Cheng | D29/102 |
| 5,737,777 | A | 4/1998 | Hilleary | 2/421 |
| 5,745,924 | A | 5/1998 | Egger | 2/425 |
| 5,794,274 | A | 8/1998 | Kraemer | 2/421 |
| 5,815,846 | A | 10/1998 | Calonge | 2/413 |
| 5,815,847 | A * | 10/1998 | Holden, Jr. | 2/418 |
| 5,946,735 | A | 9/1999 | Bayes | 2/421 |
| 6,009,561 | A | 1/2000 | Bullock et al. | 2/422 |
| 6,159,324 | A * | 12/2000 | Watters et al. | 156/242 |
| 6,178,560 | B1 | 1/2001 | Halstead et al. | 2/413 |
| 6,298,483 | B1 | 10/2001 | Schiebl et al. | 2/9 |
| 6,305,030 | B1 | 10/2001 | Brignone | 2/425 |
| 6,401,259 | B1 * | 6/2002 | Epperson et al. | 2/410 |
| 6,421,829 | B2 | 7/2002 | Halstead et al. | 2/9 |
| D464,174 | S | 10/2002 | Lu | D29/102 |
| D464,175 | S | 10/2002 | Chiang | D29/102 |

(Continued)

*Primary Examiner*—Tejash Patel
(74) *Attorney, Agent, or Firm*—Dorsey & Whitney LLP

(57) ABSTRACT

The present invention relates generally to a protective helmet that includes a shell defining a shell exterior and a shell interior configured to protectively receive a wearer's head. The helmet also includes an internal support disposed in the shell interior in supportive association with the shell for supporting the shell on the wearer's head, and an adjustment member associated with the internal support for adjusting the size of the internal support to fit to the wearer's head. The adjustment member and the shell are configured and dimensioned such that the adjustment member is operable to adjust the internal support from outside the shell while the helmet is mounted on the wearer's head.

19 Claims, 6 Drawing Sheets

U.S. PATENT DOCUMENTS

| | | | | |
|---|---|---|---|---|
| 6,481,024 | B1 | 11/2002 | Grant | 2/421 |
| 6,499,147 | B2 * | 12/2002 | Schiebl et al. | 2/425 |
| 6,530,092 | B2 | 3/2003 | Pope | 2/413 |
| 6,550,071 | B2 | 4/2003 | Garneau | 2/425 |
| 6,560,787 | B2 | 5/2003 | Mendoza | 2/413 |
| 6,591,428 | B2 | 7/2003 | Halstead et al. | 2/413 |
| 6,637,091 | B2 | 10/2003 | Halstead et al. | 29/428 |
| 6,711,751 | B1 | 3/2004 | Muskovitz | 2/410 |
| 6,763,524 | B2 | 7/2004 | Halstead et al. | 2/9 |
| 6,772,447 | B2 | 8/2004 | Morrow et al. | 2/424 |
| 6,862,747 | B2 * | 3/2005 | Oleson | 2/416 |
| 2002/0120978 | A1 | 9/2002 | Moore, III | 2/412 |
| 2002/0124298 | A1 | 9/2002 | Muskovitz | 2/410 |
| 2003/0056279 | A1 | 3/2003 | Garneau | 2/425 |
| 2003/0135914 | A1 | 7/2003 | Racine et al. | 2/413 |
| 2003/0167558 | A1 | 9/2003 | Broersma | 2/410 |
| 2004/0003452 | A1 | 1/2004 | Schiebl | 2/421 |
| 2004/0098793 | A1 | 5/2004 | Gershenson | 2/425 |
| 2004/0163161 | A1 | 8/2004 | Morrow et al. | 2/410 |

* cited by examiner

PROTECTIVE HELMET WITH ADJUSTABLE SUPPORT

FIELD OF THE INVENTION

The present invention relates generally to protective headwear. More particularly, the invention relates to a protective helmet including an internal support that is adjustable while a user is wearing the helmet.

BACKGROUND OF THE INVENTION

Protective helmets and headwear are known to protect a wearer's head from accidental trauma. For example, construction workers are often required to wear hard hats or other safety headwear due to the increased risk of falling objects in and around construction sites. Similarly, athletes are required to wear protective helmets, such as football, baseball, hockey, lacrosse, skiing, snowboarding, skydiving, and cycling helmets, to protect their heads in case of high impact collisions. These helmets are typically made of a hard and durable material designed to deflect and disperse the effects of external forces imparted thereto.

Various components of protective helmets and headwear are generally known in the industry and have been described in previous patent references. For example, U.S. Pat. No. 6,763,524 discloses a helmet with a faceguard, U.S. Pat. No. 6,711,751 discloses a helmet with a polycarbonate shell and foam liner, and U.S. Publication No. US 2002/0120978 discloses a helmet with a slow recovery, viscoelastic, polymeric foam liner.

In addition to the important protective characteristics of such helmets, the helmets also need to be comfortable when worn because the helmet is typically worn for extended periods of time. To accommodate people with different head sizes, protective helmets are typically manufactured in various standard sizes, such as, small, medium, large, and extra large. To further enhance the comfort, fit, and shock absorption of a helmet, some helmets also include an internal support within the interior of the helmet. The internal support is often adjustable to provide a custom fit on the wearer's head.

Adjustments to the internal support, however, can only be made from within the interior of the protective helmet. For example, U.S. Pat. No. 3,590,388 discloses an interior suspension cap or internal support mounted to and contained within a shell of a helmet. Thus, achieving a comfortable fit typically requires that the person initially try on the helmet, then remove the helmet to either increase or decrease the size of the internal support accordingly, and then put the helmet back on to see if the adjustment was proper. This usually involves several iterations until an acceptable comfort fit is achieved, and thus, can become a tedious and annoying process.

Thus, there remains a need for a protective helmet that can be easily adjusted to provide a comfort fit while the person is wearing the helmet.

SUMMARY OF THE INVENTION

A preferred embodiment of the present invention relates to a protective helmet that includes a shell defining a shell exterior and a shell interior configured to protectively receive a wearer's head. The helmet also includes an internal support disposed in the shell interior in supportive association with the shell for supporting the shell on the wearer's head. Additionally, the helmet includes an adjustment member associated with the internal support for adjusting the size of the internal support to fit to the wearer's head. The adjustment member and the shell are configured and dimensioned such that the adjustment member is operable to adjust the internal support from outside the shell while the helmet is mounted on the wearer's head.

Preferably, the shell further defines at least one adjustment aperture, and the adjustment member extends from the internal support through the adjustment aperture to the exterior of the shell for manipulation and operation from outside the shell. Additionally, a padding member is preferably mounted in the interior of the shell adjacent the adjustment aperture, and is configured for protecting the wearer's head against shock and maintaining the wearer's head spaced from the shell adjacent the aperture.

In one embodiment, a padding member is disposed between the internal support and the shell. This padding member defines a padding opening therethrough, and the adjustment member preferably extends through the padding opening and the adjustment aperture to allow manipulation of the adjustment member outside the shell. Preferably, the padding member maintains a spacing between the wearer's head in the internal support and the shell. In another embodiment, the internal support extends around or behind a padding member, preferably on opposite sides thereof.

The adjustment member is configured for securing outside the shell to another portion of the helmet for securing the internal support in a selected adjustment position. Preferably, the internal support tends to bias the wearer's head towards the padding member when the adjustment member is secured outside the shell. In a preferred embodiment, the adjustment member comprises first and second adjustment portions that extend through at least one aperture in the shell for securing outside the shell. Further, the shell can include first and second apertures through which the first and second adjustment portions extend, respectively.

The adjustment portions can be adjustably fastenable to the exterior shell, or to each other outside the shell, for securing the internal support in the selected adjustment position, and they also preferably include fasteners configured to accomplish this fastening.

The protective helmet can also include a cover member that is removably mountable to the exterior of the shell. The cover member is preferably positioned for at least covering a portion of, and preferably the entire, adjustment apertures and the adjustable member that extends therethrough.

The internal support preferably includes a suspension support associated with the shell to suspend the shell from the wearer's head. In a preferred embodiment, the internal support has a webbing that includes a circumferential portion configured for extending generally circumferentially and around the wearer's head, such as in a generally horizontal direction. The circumference of the circumferential portion is preferably adjustable by the adjustment member. Additionally, the webbing preferably further includes overhead portions extending over the top of the wearer's head from one side of circumferential portion to another. The circumferential portion of the webbing is preferably attached to at least one portion of the interior shell, and the adjustable member includes an end portion of the webbing. Preferably, the adjustment member includes an end portion of the webbing. Also, the circumferential portion of the webbing is anchored to the shell at a location remote from the adjustment member.

In a football helmet embodiment, for example, a chin strap and face guard can be provided coupled to the shell. The face guard is preferably configured and dimensioned for covering at least a portion of the wearer's face while the wearer is wearing the helmet.

The present invention thus facilitates adjustment to fit the protective helmet.

DETAILED DESCRIPTION OF THE PREFERRED EMBODIMENTS

Figure 1:
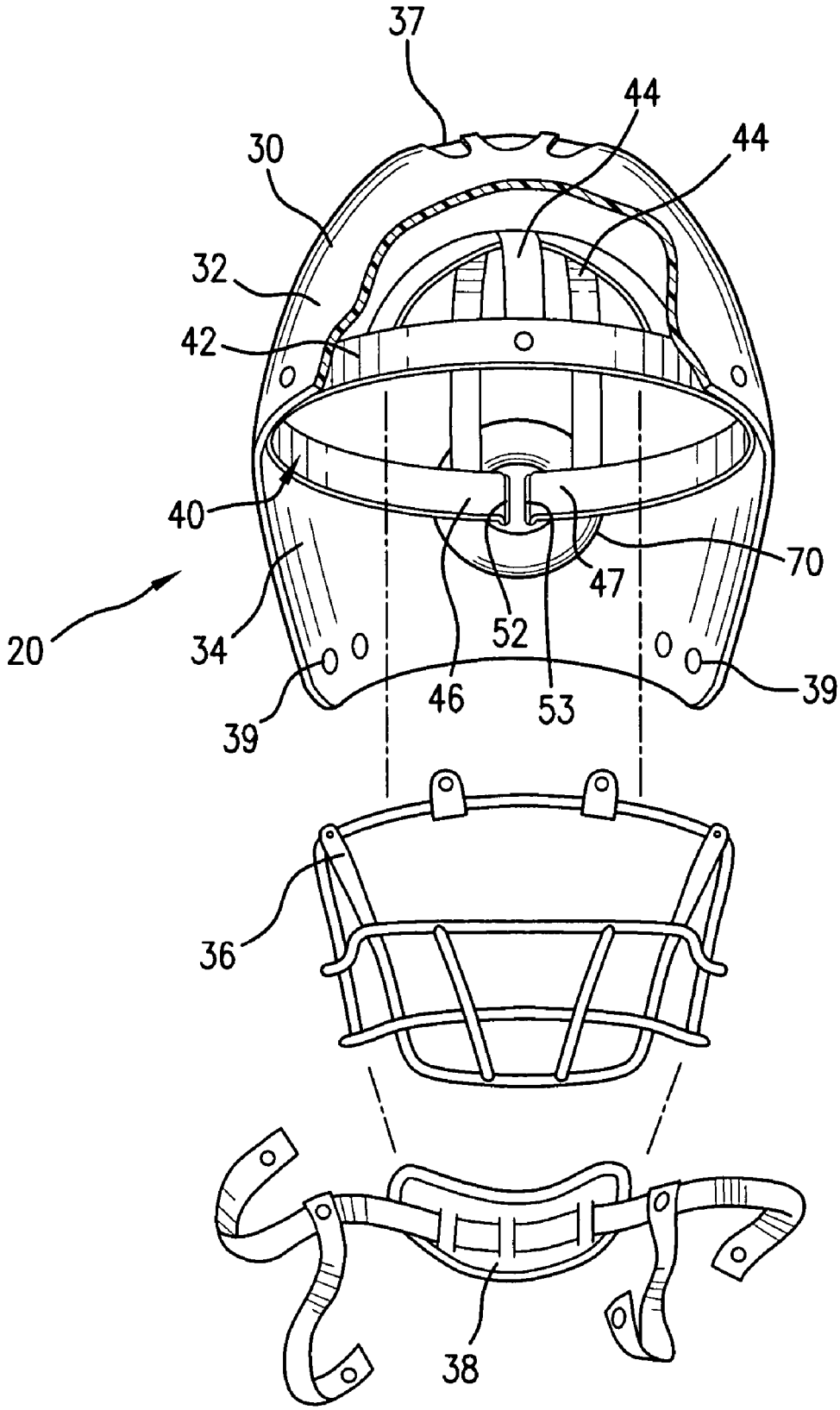
FIG. 1 is an exploded front view of one embodiment of the protective helmet of the present invention.
Figure 2:
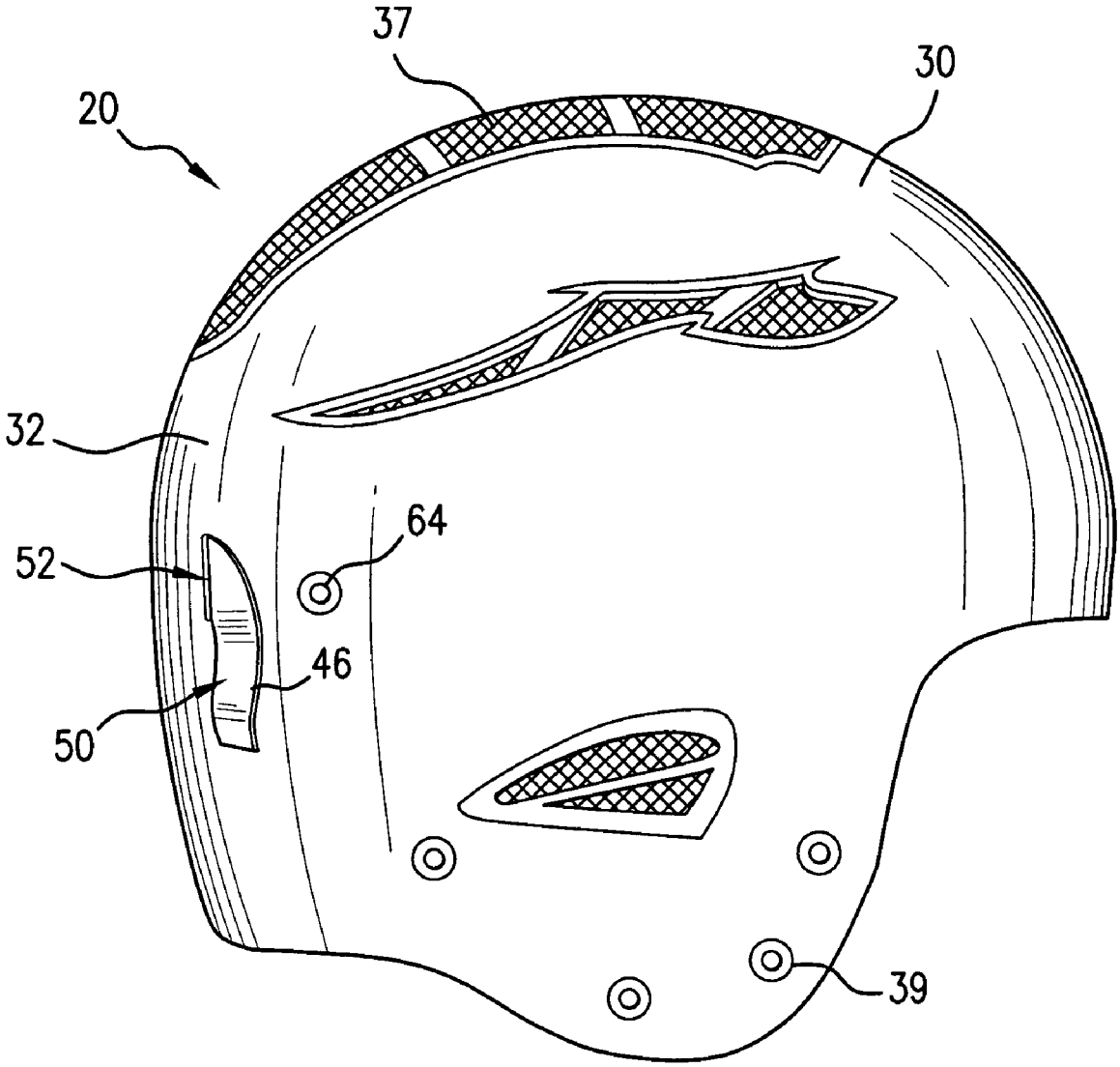
FIG. 2 is a side view of the helmet.
Figure 3:
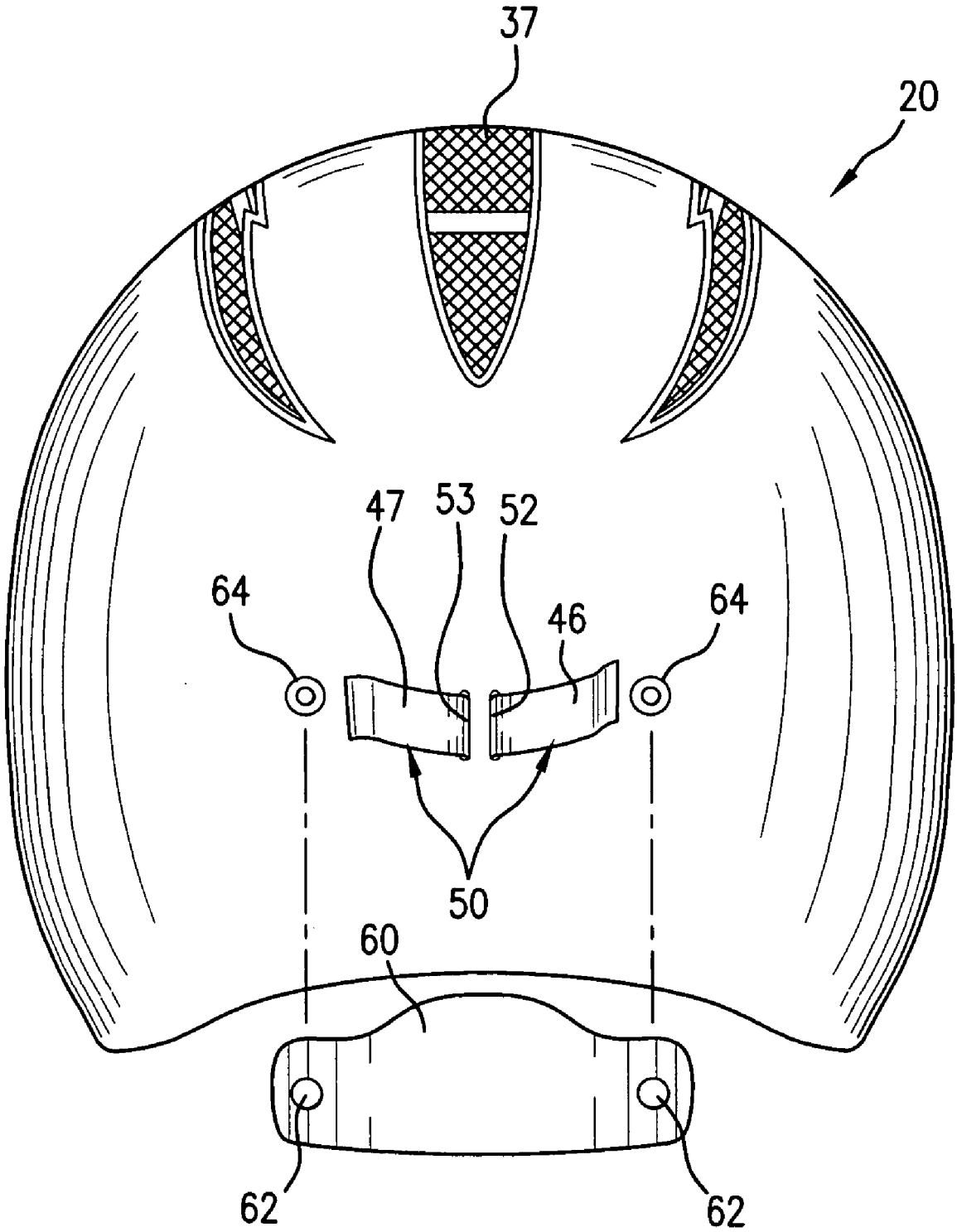
FIG. 3 is a rear view thereof.

The present invention is directed to a protective helmet that is configured to cover and protect at least a portion of a wearer's head. Referring to a preferred embodiment as shown in FIGS. 1-3, a helmet 20 preferably includes a shell 30, an internal support 40, and an adjustment member 50. The shell 30 includes an exterior surface 32 and an interior surface 34. The interior surface 34 is preferably configured to fit and receive the wearer's head therein. One of ordinary skill in the art will understand that the helmet 20 may be made in a variety of sizes to fit ranges of head sizes, for example, ranges of the standard head sizes for children and adults, which can be made in small, medium, large, and extra-large sizes. Additionally, the shell 30 is preferably made of a hard and durable material, such as a high-impact resistant polycarbonate, although other suitable materials can be used.

A plurality of vents 37 are preferably disposed about the shell 30. Advantageously, the vents 37 reduce the overall weight of the helmet 20, and also provide cooling air to the wearer's head while the person is wearing the helmet 20. Additionally, the vents 37 can provide a shock-absorbing system that allows air to be released from the interior of the helmet 20 instead of being compressed within the helmet upon impact or collision. This system advantageously reduces the forces transmitted to the wearer's head that are caused by impact or collision. An alternate embodiment of the helmet does not include vents.

Figure 4:
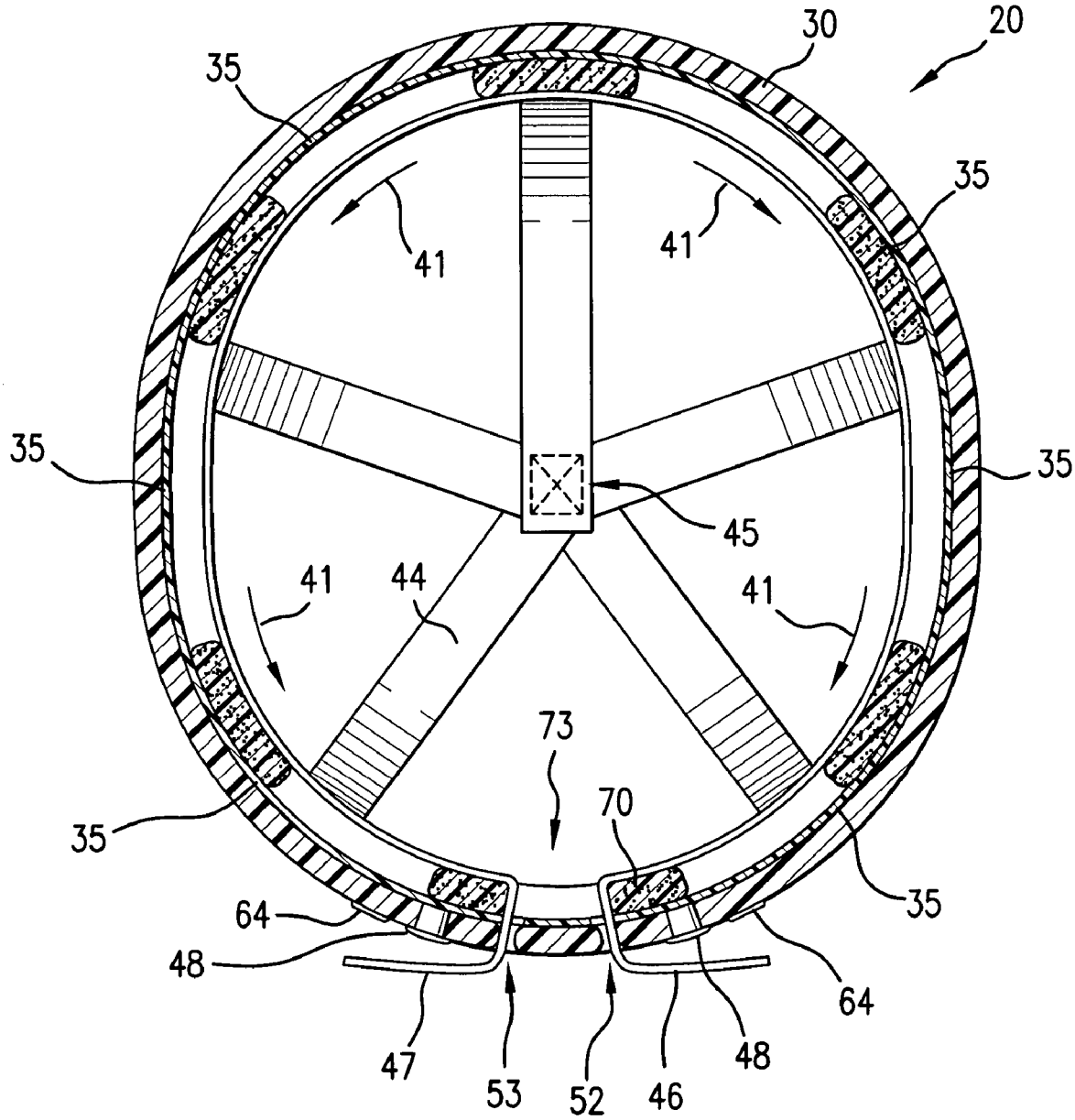
FIG. 4 is a cross-sectional, bottom view of another embodiment of the protective helmet.
Figure 5:
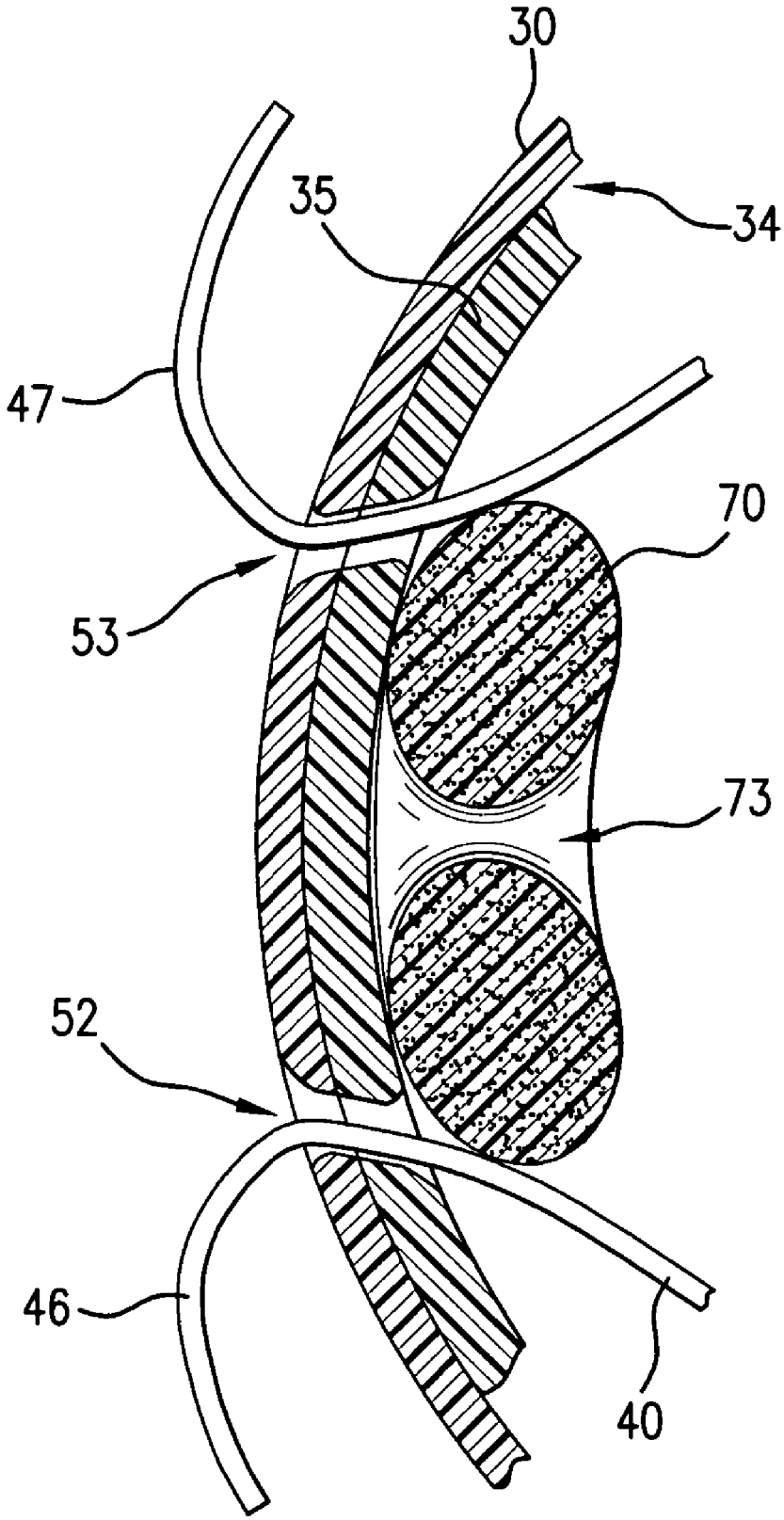
FIG. 5 is a cut-away bottom view of a rear portion of another embodiment of the protective helmet.

As shown in FIGS. 4 and 5, the helmet 20 also preferably includes padding members 35 attached about the interior surface 34 of the shell that are configured for providing further protection around the wearer's head. The padding members 35 are made of a contiguous, shock absorbing material, such as a foam or a gel, that has a thickness of at least about an ⅛ inch, and more preferably of at least about a ½ inch, depending on the material used. The padding members preferably are light in weight, and preferably have a slow memory to increase the time of deceleration upon impact or collision to the helmet 20. This also advantageously reduces the forces transmitted to the wearer's head that are caused by impact or collision.

Referring again to FIG. 1, the helmet 20 also preferably includes a guard, such as a face guard 36, and a chin strap 38. The face guard 36 is mounted, and preferably is fixedly coupled, to the shell 30, such as by fasteners, including threaded fasteners, or by welding, and is configured to cover at least a portion of the wearer's head, and preferably the face, when the helmet 20 is worn. Preferably, the face guard 36 is made of a rigid material. Suitable materials include titanium, and the preferred face guard 36 has an open, cage-like configuration. The chin strap 38 is preferably removably coupled to the shell 30 at fastening locations 39 on either side of the shell exterior 32. When the person is wearing the helmet 20, the ends of the chin strap 38 are configured to fasten to either side of the shell 30 at fastening locations 39, and the portion of the chin strap 38 between the ends is configured to associate with the wearer's chin to prevent or resist removal of the helmet 20 from the wearer's head.

The internal support 40 is preferably disposed within the interior of the shell in supportive association with the shell 30 for supporting the shell of the wearer's head. Preferably, the internal support 40 is adjustable to provide a universal fit to a wearer's head of any size. Additionally, the internal support 40 in the preferred embodiment is preferably made of a relatively elastic material so as to retain a comfortable fit on the wearer's head during extended wear. More preferably, the internal support 40 is made of a wickable material, such as polypropylene, to wick away any perspiration that may build up in the areas where the internal support 40 contacts the wearer's head. When combined with the vents 37 in the shell 30 as described above, the wickable material advantageously allows for efficient dissipation of heat and perspiration to keep the wearer's head comfortable during extended wear. Other materials, such as leather or plastic, can alternatively be used.

The internal support 40 is a suspension support that is associated with the shell 30 to suspend the shell 30 from the wearer's head when the internal support 40 is fitted thereon. The suspended association can be provided to allow for relative movement, which is preferably restricted and minimal, between the internal support 40 and the shell 30, preferably to increase the time of deceleration upon impact or collision to the helmet 20. Preferably, the shell 30 is associated with the internal support 40 such that there is at least about a 1 inch spacing, and more preferably at least about a 2 inch spacing, between the interior surface of the shell 34 and the internal support 40. Preferably, padding members 35 are located in the spacing between the internal support 40 and the interior surface of the shell 34.

The internal support 40 also preferably has a webbing structure that includes a circumferential portion 42 and a plurality of overhead portions 44 attached thereto. Preferably, the circumferential portion 42 is configured to lie in a generally horizontal plane around the wearer's head when the internal support 40 is fitted thereon. Preferably, the circumferential portion 42 extends across the wearer's forehead, around the temples and above the ears, and rearward around at least a portion of the head (e.g., near the occipital protuberance). The circumferential portion 42 is adjustable to increase or decrease the circumference thereof to fit to the size of the wearer's head. The overhead portions 44 are attached to one side of the circumferential portion 42, and extend over the top of the wearer's head to attach to an opposing portion of the circumferential portion 42. Preferably, there are at least two such overhead portions 44, and more preferably at least three overhead portions 44 (as shown in FIG. 1), attached to the circumferential portion 42 such that the internal support 40 has a webbing structure configured to supportively fit to the curved shaped of a wearer's head. The overhead portions 44 can meet, such as at a central location 45, and can attach at locations of the horizontal portion 42 on opposite sides of the head that are not necessarily diametrically opposed. In one embodiment, the overhead portions 44 are also adjustable to provide a more precise fit over the wearer's head, and in another embodiment, the overhead portions can include a single or a plurality of wide webs to form a sheet or sheets that cover the wearer's head, instead of the straps shown in FIGS. 1 and 3.

The circumferential portion 42 can be anchored to the shell interior 34 at multiple locations. Preferably, the anchoring is near the front and side portions of the helmet, for example, adjacent the area where the circumferential portion 42 contacts the wearer's forehead and temples, and above the wearer's ears. Preferably, fasteners can be used to anchor the circumferential portion 42 to the interior surface 34, and the anchoring preferably allows limited relative movement between the circumferential portion 42 and the shell to allow adjustment of the side of the circumferential portion 42. The circumferential portion 42 preferably is open on one side, and includes end portions 46,47 that are discontinuous with respect to each other and are preferably part of the adjustment member 50. The open side is preferably at the rear of the helmet 20.

The adjustment member 50 is preferably associated with the internal support 40 for adjusting the size of the internal support 40 to fit the wearer's head. Preferably, the adjustment member 50 is operable to adjust the internal support 40 from outside the shell 20, to enable adjustments while the person is wearing the helmet 20. In one embodiment, the adjustments to the internal support 40 can be made with the aid of another person, such as a teammate, trainer, or co-worker, or alternatively by the wearer himself or herself.

The adjustment member 50 of FIGS. 1-3 comprises end portions 46,47 of the circumferential portion 42. Preferably, the end portions 46,47 extend from the shell interior 34 to the shell exterior 32 such that the end portion 46,47 can be manipulated from outside the shell 30 to adjust the circumference of the internal support 40. For example, the end portions 46,47 can be pulled in the direction away from the exterior surface of the shell 32 to decrease the circumference of the circumferential portion 42 and thus reduce the size of the internal support 40 that is fitted on the wearer's head. The shell 30 preferably includes two apertures 52,53, preferably located near the portion of the shell 30 that covers the occipital protuberance of the wearer's head, and the end portions 46,47 are configured to extend through the apertures 52,53 so to permit manipulation of the end portions 46,47 from outside the shell 30 to adjust the sizing of the internal support 40.

After adjustment of the end portions 46,47 to provide a proper fit of the internal support 40 to the wearer's head, the internal support 40 is preferably fixed in the selected adjusted position. For example, the end portions 46,47 may be removably fixed to the exterior surface of the shell 32 to maintain the internal support 40 in the adjusted position about the wearer's head. Alternatively, the end portions 46,47 may be removably fixed to each other outside the shell 30 to maintain the adjusted position of the internal support 40. Removably fixing the end portions 46,47 outside the shell 30 is preferably achieved by using disengageable fasteners, such as clips, snaps, ties, buckles, hook and loop fasteners, screws, or bolts.

Figure 6:
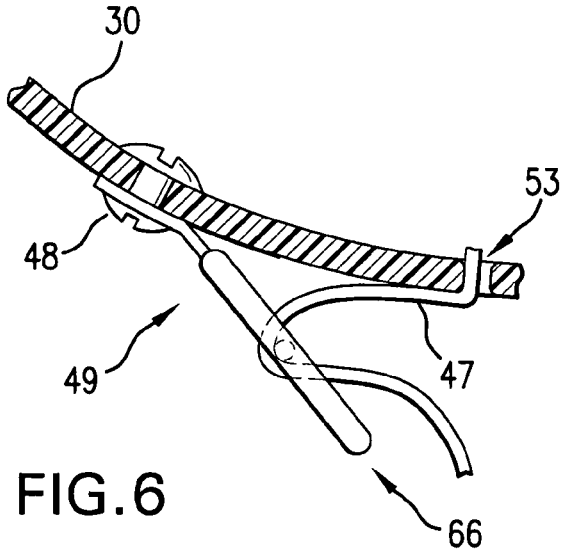
FIG. 6 is a cut-away, top view of the rear of an embodiment of a helmet, showing the association of an end portion at a fastening location.
Figure 7:
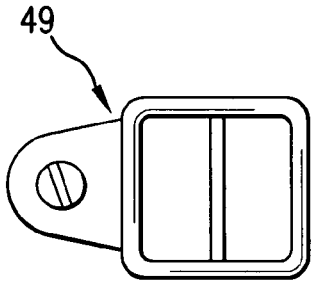
FIG. 7 is a rear view of a buckle of the embodiment of FIG. 6.

As shown in FIGS. 6 and 7, an embodiment of the shell 30 includes at least two engagement members that are configured for receiving the end portions. For example, the engagement member of FIG. 6 is a buckle 49 secured to the shell 30, for example with a fastener 48, such as a bolt or rivet. The buckle 49 also includes a receiving portion 66 that is preferably pivotally mounted to the shell 30 by the fastener 48, and is configured to adjustably receive and couple with the end portion 47 for fixing the end portion outside the shell 30. Alternative embodiments can have clasps, hooks, strap buckles, snaps, or other suitable buckles and engagement portions. The buckle 49 shown in FIG. 7 is slide-lock clamp, configured for adjustable engagement with the end portion 47.

Figure 8:
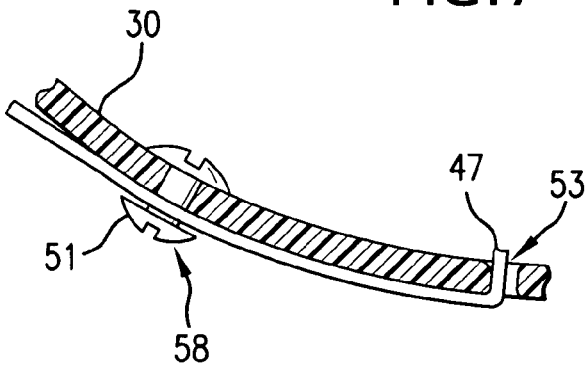
FIG. 8 is a cut-away, top view of the rear of another embodiment of the helmet, showing the association of an end portion to a fastening location.
Figure 9:
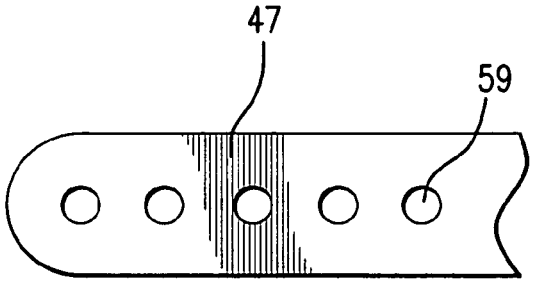
FIG. 9 is a rear view of an end portion of the embodiment of FIG. 8.

The engagement portion shown in FIGS. 8 and 9 is a removable fastener 58, such as a thread fastener. Preferably, the end portion 47 includes a plurality of apertures 59 spaced along the length thereof. In one embodiment, a fixed post, such as the head 51 of the fastener 58, is fixed in the shell 30, and the end portion 47 is made of an elastic material such that the apertures 59 can expand to receive the post 51 for securing thereto. The plurality of apertures 59 spaced along the length of the end portion 47 allows the end portion to be selectably and disengageably fixed outside the shell at a variety of locations.

In another embodiment, the shell includes a single aperture through which both end portions of the internal support pass for manipulation of the end portions outside of the shell. In yet another embodiment, the adjustment member includes a single end portion of internal support that is configured to pass through a single aperture in the shell for manipulation outside the shell, and the circumferential portion can be a closed or open loop. Alternatively, the adjustment member can be configured to extend through the bottom of the helmet such that it is operable for adjusting the internal support near the back of the wearer's neck.

As shown in FIGS. 2 and 3, the preferred embodiment further includes a cover 60 that is configured for removably mounting to the exterior surface 32 to preferably cover at least a portion of the apertures 52,53 and/or the end portions 46,47 extending through the apertures 52,53 and fixed outside the shell 30. Preferably, the cover 60 is also made of a hard, durable, and preferably resilient material, such as polycarbonate. When attached to the exterior surface 32, the cover 60 advantageously protects the end portions 46,47 and prevents them from becoming unsecured due to incidental interference or impact with the exterior surface 32.

Preferably, the cover 60 includes at least one fastener 62 that is configured for engaging to a corresponding fastening location 64 on the shell's exterior surface 32 to removably mount the cover 60 thereto. Preferably, the fastener 62 is a clip, snap, buckle, threaded fastener, or hook and loop fastener such that the person wearing the helmet 20 can quickly remove and replace the cover 60 before and after adjustment of the end portions 46,47. In the preferred embodiment, the fasteners 62 are quarter-turn or half-turn screws, so that the person wearing the helmet 20, or an assistant, can quickly remove and replace the cover 60. Preferably, fasteners on the exterior of the helmet are generally smooth or are configured to prevent catching on items that may come into contact therewith. The cover 60 can also provide a smooth surface with reduced sharp protrusions.

Referring to the embodiments of FIGS. 1, 4 and 5, one of the padding members 35 that is attached to the interior surface of the shell 34, preferably a rear padding member 70, is disposed adjacent the apertures 52,53 of the shell 30. In the embodiment of FIG. 4, the rear padding member 70 is configured for placement between the internal support 40 and the interior surface 34 for maintaining a protective spacing between the occipital protuberance of the wearer's head and the shell. The rear padding member 70 has at least one padding opening 73, and an additional padding member can be provided in the opening to define two separate padding openings. The rear padding member 70 has a generally donut-shaped configuration. The rear padding member can alternatively have a U-shaped configuration, or can include a plurality of padding members than define an opening or openings therebetween. As shown in FIG. 4, the end portions 46,47 preferably extend through the padding opening 73 and the apertures 52,53 for adjustment of the internal support 40 outside the shell 30. On the other hand, in the embodiment of FIG. 5, the end portions 46,47 extend around the sides and/or behind the rear padding member 70.

During adjustment of the adjustment member 50 to change the fit of the circumferential portion 40, the circumferential portion is usually pulled in a predetermined direction towards the apertures 52,53. In a preferred embodiment, the circumferential portion is pulled toward the rear of the helmet in the direction 41, as shown in FIG. 4, and thus the wearer's head also tends to bias towards or is pulled closer to the interior shell 34 of helmet. Placement of the rear padding member 70 adjacent the apertures 52,53 advantageously maintains the spacing between the wearer's head and the interior of the shell, thereby providing further protection and comfort to the wearer's head.

Preferably, the rear padding member 70 is made of the same material and has at least the same thickness as the other padding members 35 that are attached to the interior surface 34 of the shell, although these parameters can be varied in other embodiments. More preferably, the rear padding member is made of a gel material, and has a thickness of at least about 1 inch to provide added protection to the rear of the wearer's head. In yet another embodiment, only one padding member is included in the interior of the helmet and is disposed at the rear of the helmet adjacent the apertures.

While illustrative embodiments of the invention are disclosed herein, it will be appreciated that numerous modifications and other embodiments can be devised by those skilled in the art. Features of the embodiments described herein, can be combined, separated, interchanged, and/or rearranged to generate other embodiments. Also, it is understood that some embodiments can be modified for football, baseball, hockey, lacrosse, skiing, snowboarding, skydiving, and cycling helmets, or other activities in which the wearer is susceptible to head impact. Therefore, it will be understood that the appended claims are intended to cover all such modifications and embodiments that come within the spirit and scope of the present invention.

What is claimed is:

1. A protective helmet, comprising:

a shell defining a shell exterior and a shell interior and at least one adjustment aperture, and being configured to receive a wearer's head and extend and protectively cover the head circumferentially and vertically over the top of the head;

an internal support disposed within the shell interior in supportive association with the shell for supporting the shell on the wearer's head;

an adjustment member associated with the internal support for adjusting the size of the internal support to fit the wearer's head, wherein the adjustment member extends from the internal support through the adjustment aperture to the shell exterior for manipulation and operation from outside the shell to adjust the internal support from outside the shell while the helmet is mounted on the wearer's head; and a cover member that is removably mountable to the shell exterior in a position at least covering a portion of the adjustment aperture and adjustment member that extends therethrough.

2. The protective helmet of claim 1, further comprising a first padding member mounted in the interior of the shell adjacent the adjustment aperture configured for protecting the wearer's head against shock and maintaining the wearer's head spaced from the shell adjacent the aperture.

3. The protective helmet of claim 2, wherein the first padding member is disposed between the internal support and the shell, and defines a padding opening, the adjustment member extending through the padding opening and the adjustment aperture.

4. The protective member of claim 2, wherein the adjustment member extends around the first padding member on opposite sides thereof.

5. The protective helmet of claim 2, wherein the adjustment member is securable outside the shell to selectively secure the internal support in an adjusted position, and the internal support and adjustment member are associated with the shell such that the internal support tends to bias the wearer's head towards the first padding member when the adjustment member is secured outside the shell.

6. The protective helmet of claim 1, wherein the cover is removably mountable to the shell exterior to substantially cover the entire adjustment aperture and adjustment member.

7. The protective helmet of claim 2, further comprising additional padding members disposed in the interior of the shell and configured for providing impact protection to the wearer's head.

8. The protective helmet of claim 1, wherein the adjustment member is configured for securing outside the shell to another portion of the helmet to selectively secure the internal support in one of a plurality of adjustment positions.

9. The protective helmet of claim 8, wherein the adjustment member comprises first and second adjustment portions that extend through the aperture for securing outside the shell.

10. The protective helmet of claim 9, wherein the at least one aperture comprises first and second apertures through which the first and second adjustment portions extend, respectively.

11. The protective helmet of claim 9, wherein the first and second adjustment portions are adjustably fastenable to the exterior shell for securing the internal support in the adjustment position.

12. The protective helmet of claim 9, wherein the first and second adjustment portions are adjustably fastenable to each other outside the shell for securing the internal support in the adjustment position.

13. The protective helmet of claim 1, wherein the internal support comprises a suspension support associated with the shell to suspend the shell from the wearer's head.

14. The protective helmet of claim 1, wherein the internal support comprises a webbing comprising a circumferential portion having a circumferential size and being configured for extending and substantially completely circumferentially around the wearer's head, the adjustment member being associated with the circumferential portion for adjusting the circumferential size.

15. The protective helmet of claim 14, wherein the circumferential portion is configured to extend generally horizontally around the wearer's head, and the webbing comprises overhead portions configured to extend over top the wearer's head from one side of circumferential portion to another.

16. The protective helmet of claim 14, wherein the adjustment member comprises an end portion of the webbing.

17. The protective helmet of claim 14, wherein the circumferential portion of the webbing is anchored to the shell at a location remote from the adjustment portion.

18. The protective helmet of claim 1, further comprising:

a face guard mounted to the shell and configured and dimensioned for covering and protecting at least a portion of the wearer's face while the wearer is wearing the helmet; and a chin strap associated with the shell for mounting to the wearer's chin.

19. A protective helmet, comprising:

a shell defining a shell exterior, a shell interior, and an adjustment aperture communicating the exterior and the interior, the shell being configured to receive a wearer's head and extend across and protectively cover the sides, back, and top of the wearer's head;

an internal support disposed within the shell interior in supportive association with the shell for supporting the shell on the wearer's head; and an adjustment member associated with the internal support for adjusting the size of the internal support to fit the wearer's head, wherein the adjustment member extends from the internal support through the adjustment aperture to the shell exterior for manipulation and operation from outside the shell to adjust the internal support from outside the shell while the helmet is mounted on the wearer's head;

a first padding member mounted in the interior of the shell adjacent the adjustment aperture configured for protecting the wearer's head against shock and maintaining the wearer's head spaced from the shell adjacent the aperture; and a cover member that is removably mountable to the shell exterior in a position at least covering a portion of the adjustment aperture and adjustment member that extends therethrough.

* * * * *